US005347907A

United States Patent [19]

Strandli et al.

[11] Patent Number: 5,347,907

[45] Date of Patent: Sep. 20, 1994

[54] MULTIPURPOSE PROJECTILE AND A METHOD OF MAKING IT

[75] Inventors: Kare R. Strandli; Inge M. Angard; Einar Willassen, all of Raufoss, Norway

[73] Assignee: Raufoss A/S, Norway

[21] Appl. No.: 922,373

[22] Filed: Jul. 31, 1992

[30] Foreign Application Priority Data

Aug. 1, 1991 [NO] Norway ..... 912994

[51] Int. Cl.[5] ..... F42B 3/00

[52] U.S. Cl. ..... 86/20.14; 86/20.15; 102/518; 102/519

[58] Field of Search ..... 102/518, 519; 86/20.13, 86/20.14

[56] References Cited

U.S. PATENT DOCUMENTS 5,133,240 7/1992 Thiesen et al. ..... 86/20.14
5,164,533 11/1992 Schluckebier ..... 86/20.14
5,251,530 10/1993 Kaeser ..... 86/20.14

FOREIGN PATENT DOCUMENTS 150977 9/1982 Norway .

*Primary Examiner*—Peter A. Nelson
*Attorney, Agent, or Firm*—Bacon & Thomas

[57] ABSTRACT

A multipurpose projectile and a method of making it, said projectile comprising a shell (2) which contains a penetrator (1) and at least one incendiary charge (5) surrounding a portion of the penetrator in front of a well (3) in the bottom of the shell, in which the penetrator has been inserted. The incendiary charge (5) is pressed in approximately over its entire cross section by means of a plunger (14) having an annular pressing surface, and the cavity (12) in which the incendiary charge is situated is cylindrical and has a constant diameter along its entire length, whereby the pressing surface of the plunger substantially covers the entire cavity cross section between the penetrator (1) and the shell (2). The plunger is inserted through the front end of the shell, which is open prior to mounting a nose portion on the shell.

3 Claims, 1 Drawing Sheet

MULTIPURPOSE PROJECTILE AND A METHOD OF MAKING IT

The present invention relates to a multipurpose projectile containing a penetrator. Moreover, the invention relates to a method of making such a projectile. By multipurpose projectile is meant a projectile having both a penetrating effect and an incendiary effect in a target. In addition the projectile may have a fragmentary effect and/or a blast effect, by also containing an explosive charge.

An example of such a projectile is disclosed in NO Acceptance Print No. 150977. The known projectile comprises an outer shell surrounding an inner shell, and the inner shell contains a penetrator, an incendiary charge which partially surrounds the penetrator and a blast charge in front of the incendiary charge. In the front end of the outer shell is an igniter charge, adapted to ignite by impact in a target. This igniter charge may of course be replaced by an igniter mechanism, in particular in a projectile of larger caliber. The inner shell has a well in its bottom, in which the rearward end of the penetrator is inserted. The well has a larger diameter than the penetrator, and the penetrator is clamped, in that a circular cut is formed in the bottom of the shell, around the penetrator, whereupon the shell material radially inside of the circular cut is deformed inwardly into contact with the penetrator. The incendiary charge which surrounds the front portion of the penetrator will also to a certain degree contribute to keeping the penetrator coaxially aligned in the inner shell. However, the cavity in the inner shell tapers in the forward direction, and it is, therefore, not possible to insert a plunger with an outer diameter corresponding to the largest diameter of the cavity in order to press the incendiary charge. The incendiary charge will, consequently, only have a limited effect with respect to retaining and centering of the penetrator.

Another example of a projectile with an inner penetrator is disclosed in NO Acceptance Print No. 137297. In this known projectile the penetrator is in contact with the wall of the shell through its entire length, whereby no charge material is present radially outside of the penetrator. All charges in the projectile are situated in front of the penetrator (except from a tracer charge in the bottom of the shell).

The present invention relates to a projectile comprising a shell which contains a penetrator and at least one incendiary charge surrounding a portion of the penetrator in front of a well in the bottom of the shell, in which the penetrator is inserted, and the incendiary charge has been pressed in substantially over its entire cross section, whereby the cavity in the shell in which the incendiary charge is situated is cylindrical and has a constant diameter along its entire length, and the front end of the cavity is in a per se known manner closed by a nose portion mounted thereon.

Thereby is achieved the ability to press the incendiary charge by use of a plunger which has an annular pressing surface and which is inserted in the shell from the forward end prior to mounting of the nose portion. The plunger is delimited by the pressing surface and an outer and inner cylindrical surface of circular cross section, whereby the outer surface has a diameter approximately as large as that of the cavity in the shell, while the inner surface has a diameter which gives room for accommodating the penetrator inside of the plunger. Thereby pressing of the incendiary charge may be performed over its entire cross section or approximately over its entire cross section and with the desired pressure, whereby the incendiary charge acts efficiently to retaining and aligning the penetrator.

The invention also relates to a method of making the projectile, which comprises a penetrator and an incendiary charge surrounding a portion of the penetrator in front of a well in the bottom of the shell, in which the penetrator is inserted, the method comprising that upon insertion of the penetrator the incendiary charge is inserted in the shell, which has a cylindrical cavity of constant diameter, whereupon the charge is pressed approximately over its entire cross section by means of a plunger, which has an annular pressing surface which substantially covers the entire cavity cross section, said plunger being inserted from the front end of the cavity, through the open end of the shell.

The invention will in the following be explained more thoroughly , with reference to the accompanying drawing, which shows an example of a projectile according to the invention and illustrates the method according to the invention.

Figure 1:
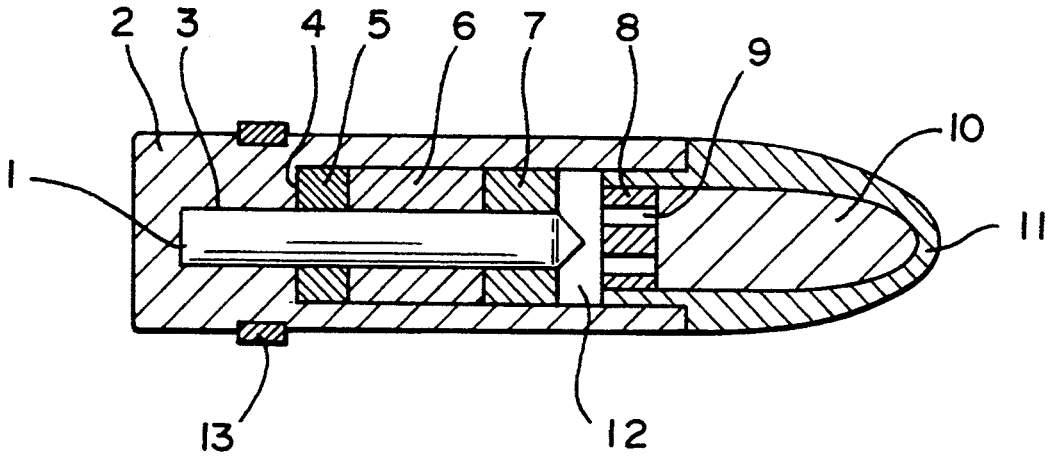
FIG. 1 shows an axial, longitudinal section through an embodiment of a projectile according to the invention.

The projectile shown in FIG. 1 comprises a penetrator 1, which preferably is made of a very hard material, as for instance tungsten carbide. The rearward end of the penetrator is inserted in a well 3 in a shell 2, and in front of the well 3 the shell has an enlarged cavity 12 which contains charges 5, 6 and 7, of which the charge 5 is an incendiary charge which has been pressed in such a manner that it contributes to retaining and centering of the penetrator 1. On the front end of the shell is mounted a nose portion 11, which in the example shown contains an igniter charge 10. The nose portion may for instance be screwed into the shell 2. In order to prevent "set-back" of the igniter charge during firing a support disc 8 is fastened in the rearward end of the nose portion. The support disc 8 may for instance be screwed into the nose portion 11. In order to provide a pyrotechnic chain rearwardly to the charges 5, 6, 7 at least one aperture 9 is provided through the support disc 8. In the example shown several apertures 9 are situated in a distance from the center of the support disc 8, in order that burning gases from the igniter charge 10 be distributed around the front end of the penetrator when flowing rearwardly. Thereby the flow of gases will not be substantially disturbed by the penetrator. The charges 5, 6 and 7 will during firing be supported by an annular surface 4 rearwardly in the shell cavity 12. The shell has, as per se known, an outer guide band 13.

Figure 2:
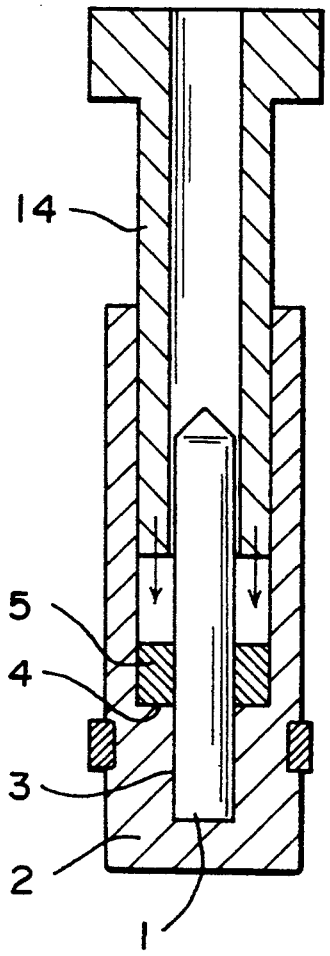
FIG. 2 shows the insertion of a pressing plunger into the shell, for pressing of an incendiary charge surrounding a portion of a penetrator.

FIG. 2 illustrates pressing of the charge 5, by means of a plunger 14 which can be inserted from the front end of the shell 2 prior to mounting of the nose portion 11 (FIG. 1). It will appear that the plunger 14 permits pressing of the charge 5 with a desired force or pressure over the entire end surface of the charge or approximately over the entire end surface.

Figure 3:
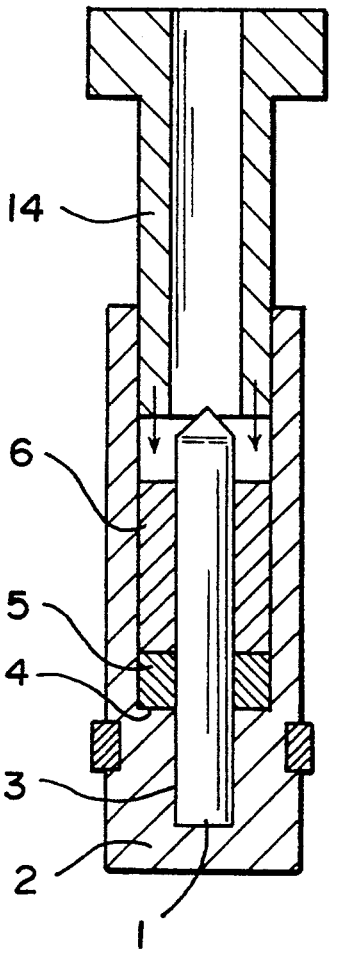
FIG. 3 shows the insertion of the same pressing plunger into the shell, for pressing of another charge in front of the pressed incendiary charge.

FIG. 3 shows a succeeding pressing of another charge 6, by means of the same plunger 14 as shown in FIG. 2.

As shown in FIGS. 2 and 3, the plunger may have a bore which exactly accommodates the penetrator, and the outer diameter may be approximately as large as the diameter of the cavity 12.

The pressing of the charges 6 and 7 may be performed with a pressure different from that used for pressing the charge 5.

Each of the charges 6 and 7 may be a blasting charge or an incendiary charge. In any case pressing can be performed with a desired pressure or force against the entire end surface of each charge.

What is claimed is:

1. A multipurpose projectile comprising a shell which contains a penetrator and at least one incendiary charge surrounding a portion of the penetrator in front of a well in the bottom of the shell, in which the penetrator is inserted, the incendiary charge having been pressed in over its entire cross section, whereby the cavity in the shell in which the incendiary charge is situated is cylindrical and has a constant diameter along its entire length, and that the front end of the cavity in a per se known manner is closed by a nose portion mounted thereon.

2. A projectile according to claim 1, in which at least one other charge has been pressed in front of the incendiary charge.

3. A method of making a multipurpose projectile which comprises a penetrator and an incendiary charge surrounding a portion of the penetrator in front of a well in the bottom of the shell, in which the penetrator is inserted, wherein, upon insertion of the penetrator, the incendiary charge is inserted in the shell, which has a cylindrical cavity of constant diameter, whereupon the charge is pressed approximately over its entire cross section by means of a plunger, which has an annular pressing surface which substantially covers the entire cavity cross section, said plunger being inserted from the front end of the cavity, through the open end of the shell.

* * * * *